US007089980B2

(12) United States Patent
Rulli

(10) Patent No.: US 7,089,980 B2
(45) Date of Patent: Aug. 15, 2006

(54) ROTATABLE WORKBENCH

(76) Inventor: Mark C. Rulli, 1920 Vine St., Berkeley, CA (US) 94709

( * ) Notice: Subject to any disclaimer, the term of this patent is extended or adjusted under 35 U.S.C. 154(b) by 0 days.

(21) Appl. No.: 10/945,780

(22) Filed: Sep. 20, 2004

(65) Prior Publication Data

US 2005/0061399 A1 Mar. 24, 2005

Related U.S. Application Data

(60) Provisional application No. 60/504,725, filed on Sep. 18, 2003.

(51) Int. Cl.
*B25H 1/02* (2006.01)
*B25H 1/12* (2006.01)

(52) U.S. Cl. ..... 144/286.1; 144/287

(58) Field of Classification Search ..... 144/285, 144/286.1, 286.5, 287; 83/471–474, 477.1, 83/477.2; 269/17, 289 R; 248/637, 676, 248/678, 679, 670–674; 108/1.3
See application file for complete search history.

(56) References Cited

U.S. PATENT DOCUMENTS 4,465,114 A * 8/1984 Schumacher ..... 144/286.1
4,523,617 A * 6/1985 Tiedemann ..... 144/286.5
5,224,531 A * 7/1993 Blohm ..... 144/285
5,431,206 A * 7/1995 McAllister ..... 144/286.1
5,529,322 A * 6/1996 Barton ..... 280/30
5,722,473 A * 3/1998 Tucker ..... 144/286.1
5,863,052 A * 1/1999 Roman ..... 280/30
5,884,681 A * 3/1999 Nickles ..... 144/329
5,957,472 A * 9/1999 Borgatti ..... 280/30
6,155,318 A * 12/2000 Underwood ..... 144/286.1
6,345,829 B1 * 2/2002 Mueller ..... 280/47.18

* cited by examiner

*Primary Examiner*—Derris H. Banks
*Assistant Examiner*—Shelly Self
(74) *Attorney, Agent, or Firm*—Stainbrook & Stainbrook, PC; Craig M. Stainbrook

(57) ABSTRACT

A multi-tool rotatable workbench of the present invention which includes a support structure and a work surface drum having work surfaces, the drum being rotatably disposed on the support structure. Each of the work surfaces includes tool attachment means for rapidly attaching and removing tools, work platforms, workpiece holding devices, and the like. Drum indexing and stop means are provided for selectively positioning and securing the work surface drum in such a configuration that at least one work surface is substantially level relative to the ground, while all other work surfaces are in a storage position.

12 Claims, 5 Drawing Sheets

ROTATABLE WORKBENCH

CROSS REFERENCE TO RELATED APPLICATIONS

The present application claims the benefit of the filing date of U.S. Provisional Patent Application, Ser. No. 60/504,725, filed Sep. 18, 2003.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to workshop workbenches, more particularly to a space-saving rotatable workbench for power tools, work platforms, and workpiece holding devices.

BACKGROUND INFORMATION AND DISCUSSION OF RELATED ART

When at the workbench, wood workers, mechanics, residential handymen, and the like are generally interested in minimizing the inconvenience and time involved in removing tools from a storage space, taking the tools to a workbench, setting them up on the bench, finding and connecting the tools to electrical power, setting up a suitable work surface for holding and supporting work pieces, and then removing the tools and placing them in storage when a task is completed or other tools are required on the limited workbench space. Space is often in short supply in both the residential and commercial workspace. Further, it can take considerable physical effort to carry and set up power tools.

Accordingly, it would be desirable to have a multi-tool workbench having a small footprint, and thus requiring minimal shop space, on which a user could conveniently store and use a number of power tools simultaneously. It would also be desirable to provide a workbench that provides power to a number of electrical power tools without the need to run numerous power cords to either separate outlets or an outlet panel. To that end, several solutions have been proposed, including that described in U.S. Pat. No. 5,431,206 to McAllister, which teaches a portable workstation having a support structure; a horizontal, generally planar, working surface supported by the support structure; a plurality of tools mounted on the working surface, each being mounted on a horizontal mounting plate. The mounting plate forms a portion of the working surface and is rotatable such that said each of the plurality of tools may be selectively rotated between a working position on top of said working surface and a stored position underneath said working surface. However, this apparatus does not teach multiple mounting surfaces on the rotatable members. Accordingly, once the mounting surface is rotated so that the tools on that member are in a stored position, there are no tools in an operating position for that rotatable member.

U.S. Pat. No. 5,722,473 to Tucker, shows a workbench base and interchangeable pallets to mount power tools. Interchangeable pallets can be provided for mounting non-electrically powered tools. When not in use, each of the pallet-mounted tools can be stored away and when a given one of the pallet-mounted tools is desired to be used it is mounted on the workbench base which it alternately shares with the other pallet-mounted tools. The apparatus does not include any means for rotating tools underneath the working surface to a stored position while simultaneously rotating another tool or other tools into an operating position.

Several combination portable workstation/tool transport devices have been proposed, including U.S. Pat. No. 6,345,829 B1, to Mueller, which discloses a hand-truck-type convertible apparatus for transporting and supporting a work tool at a work site. The apparatus has an extended and a collapsed position, and a vertical work configuration and a horizontal transport configuration. It includes a support frame extending along a longitudinal axis between a first end and a second end. A base member extends from the support frame in a direction perpendicular to the longitudinal axis of the support frame and stabilizes the support frame in its vertical, working position. A primary wheel assembly is mounted to the support frame opposite the base member such that the primary wheel assembly and the base member stabilize the support frame in its vertical, working position. A work platform is mounted to the second end of the support frame and is movable between an extended position and a collapsed position. The work platform is supported in its extended position by a pair of brace members that extend from opposite sides of the work platform. The brace members are each received within a locking device to secure the work platform in an extended position. The locking devices can be released to allow the work platform to move from the extended position to the collapsed position. The apparatus further includes an electrical outlet box mounted on its rear surface, offering the user multiple individual outlets; it is connected to a power source through a cord.

U.S. Pat. No. 5,957,472 to Borganti, teaches a combined hand truck and machine stand, wherein one configuration can readily be converted into the other. The device includes a first frame support pivotally coupled to a second frame support for movement between a first position forming a hand truck and a second position forming a machine stand. A machine support is pivotally coupled to the first frame support and is movable between a first position forming the hand truck and a second position forming the machine stand. A base plate is pivotally coupled to a lower portion of the first frame support, and is movable between a first position pivoted outwardly relative to the first frame support and locked in place to prevent the apparatus from toppling when in the form of a hand truck, and a second position pivoted inwardly relative to the first frame support when the apparatus is in the form of a machine stand. The second frame support includes a pair of legs and a cross-piece support extending between and coupled for rotation to each leg. A plate defining a flat surface for engaging the machine support is fixed to the cross-piece support, and a handle is coupled to, and extends outwardly from the plate. When the apparatus is in the form of a hand truck, the plate engages the machine support to thereby prevent rotation of the cross-piece support and allow the handle to be used to move the hand truck. When the apparatus is configured as a machine stand, the cross-piece support forms a buttress for contacting and supporting the machine support.

U.S. Pat. No. 5,529,322 to Barton, shows a combination transport device and work surface has a collapsible support member and base member. In the collapsed position, the support member and base member are close to a stem of the device to define a transport surface. The transport surface can be easily moved via a handle and wheels. In the extended position, the support member and the base member extend transversely from the stem to define a work surface and a support base respectively.

U.S. Pat. No. 5,224,531 to Blohm, discloses a portable apparatus for storing tools in an organized fashion and which also converts to a combination saw table, router table and workbench. The apparatus can be readily maneuvered, loaded into a truck bed and stored when folded. It also provides a rigid work surface with easy tool access when in the set-up position.

At present in the market place, Ryobi Technologies, Inc., offers a portable toolbox on wheels having sliding drawers for holding it's 18.0V Six Pack, which includes a drill/driver, compound miter saw, circular saw, reciprocating saw, SPEED SAW™, and flashlight, along with three rechargeable battery packs and a one-hour diagnostic charger. The tool box on wheels doubles as a miter saw work stand.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein. For instance, none of the foregoing patents describes an apparatus that has means for selectively rotating a power tool into position for use while simultaneously rotating unused tools out of the way and into a storage position.

BRIEF SUMMARY OF THE INVENTION

Accordingly, it is a principal object of the present invention to provide a rotatable power tool workbench having a plurality of work surfaces or work areas, each of which is capable of providing a support for at least one power tool.

It is a further object of the present invention to provide a rotatable power tool workbench in which stored tools may be easily and conveniently moved to operating positions, while tools formerly or prospectively to be in an operating position are rotated into a stored position.

It is yet another object of the invention to provide a multi-tool rotatable power tool workbench that can be easily transported to a job site.

Still a further object of the present invention is to provide a multi-tool rotatable workbench that presents a selected tool in an easy to reach configuration.

Yet another object of the present invention is to provide a multi-tool rotatable workbench that is lightweight and is easy to transport and/or reposition in a workspace with multiple tools attached to its several working surfaces.

Another object of the present invention is to provide a multi-tool workbench that economizes on the space required for supporting operable power tools.

A still further object of the present invention is to provide a rotatable workbench for power tools that allows for rapid installation and removal of the tools both singly and collectively.

A further object of the present invention is to provide a multi-tool rotatable workbench that is economical in design and manufacture and that will be affordable to the ordinary consumer.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein.

REFERENCE NUMBER LEGEND

Figure 1:
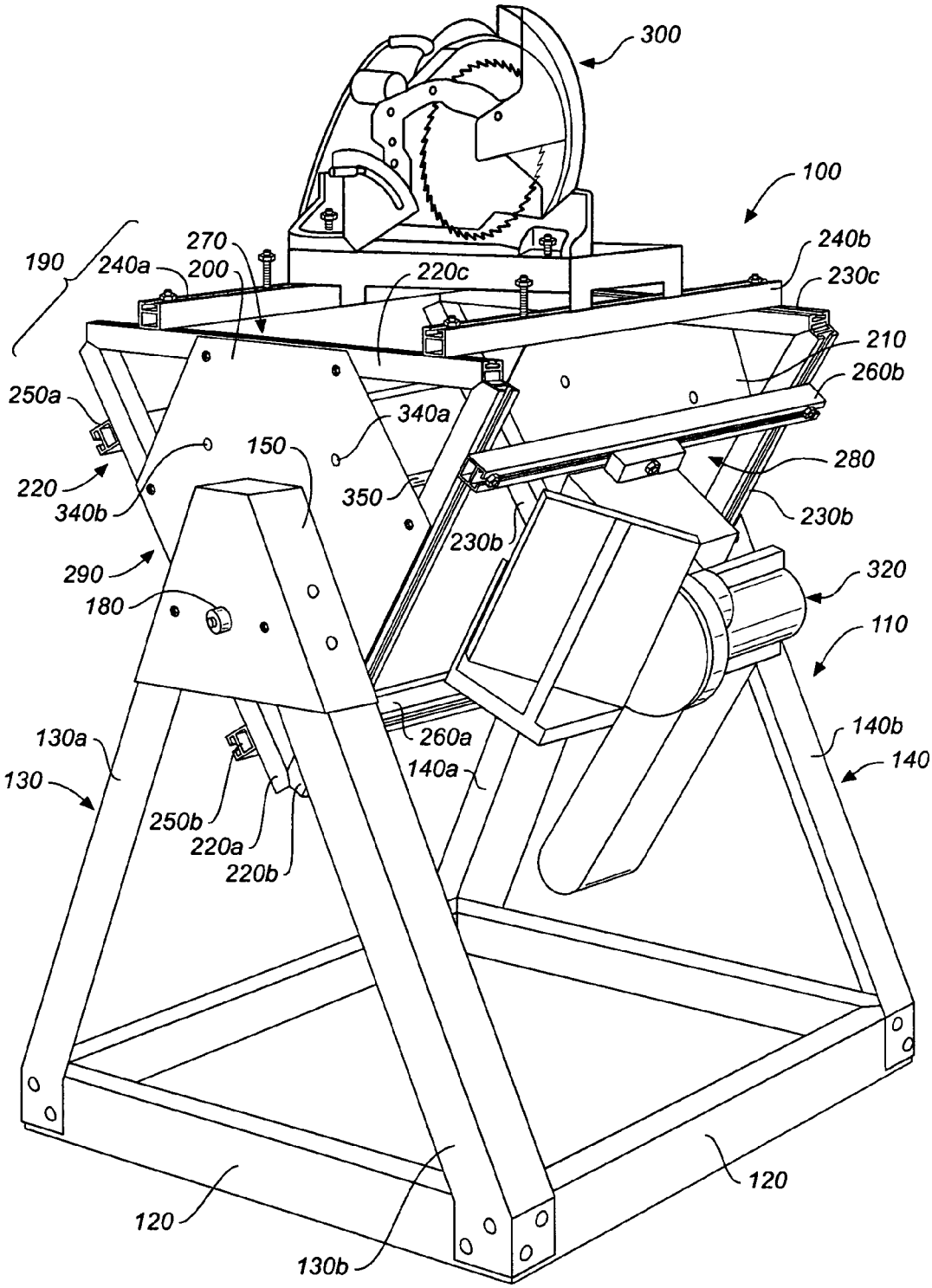
FIG. 1 is a perspective view of the rotatable power tool workbench of the present invention, shown with a miter saw installed on the upper platform.

100 rotatable power tool workbench
110 supporting frame
120 base
130 first angled side support
140 second angled side support
150 first triangular end cap
160 second triangular end cap
170 hole for ball detent or clevis pin
180 ball detent or clevis pin
185 nylon pull handles
190 rotatable work surface drum
200 first end plate
210 second end plate
220 first mounting rail frame
220*a–c* first mounting rail frame extrusions
230 second mounting rail frame
230*a–c* second mounting rail frame extrusions
240*a–b* first tool mounting rails
250*a–b* second tool mounting rails
260*a–b* third tool mounting rails
270 first work surface (open rail platform)
280 second work surface (open rail platform)
290 third work surface (open rail platform)
300 power tool (miter saw)
320 power tool (belt sander)
330 mounting bolts
340*a–c* indexing holes
350 axle
360 bearings
370 quick release nut and bolt assembly
380 wheels

DETAILED DESCRIPTION OF THE INVENTION

Referring to FIGS. 1 through 6, wherein like reference numerals refer to like components in the various views, there is illustrated therein a new and improved rotatable power tool workbench, generally denominated 100 herein.

Figure 2:
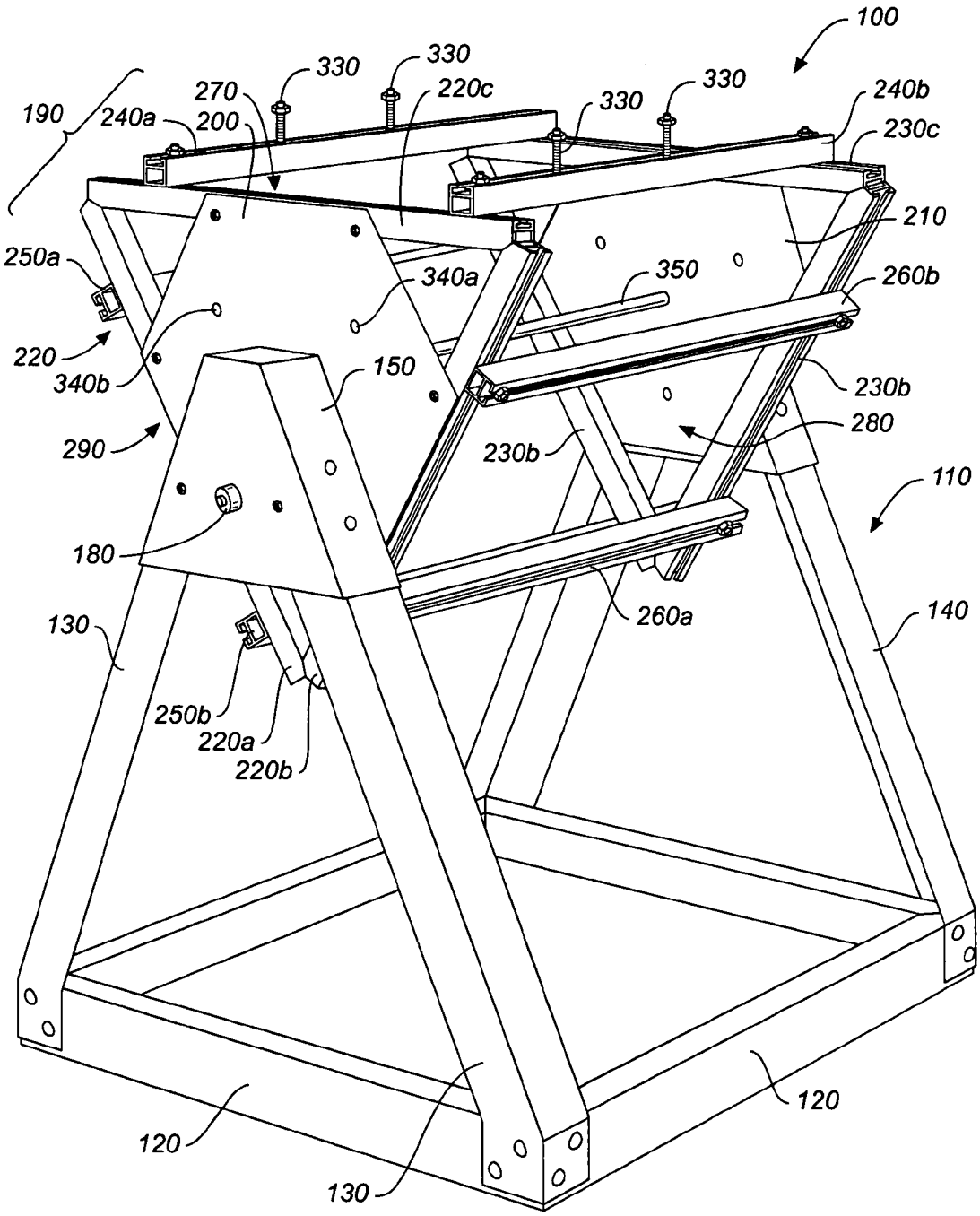
FIG. 2 is a perspective of the apparatus of FIG. 1 with the saw removed.
Figure 4:
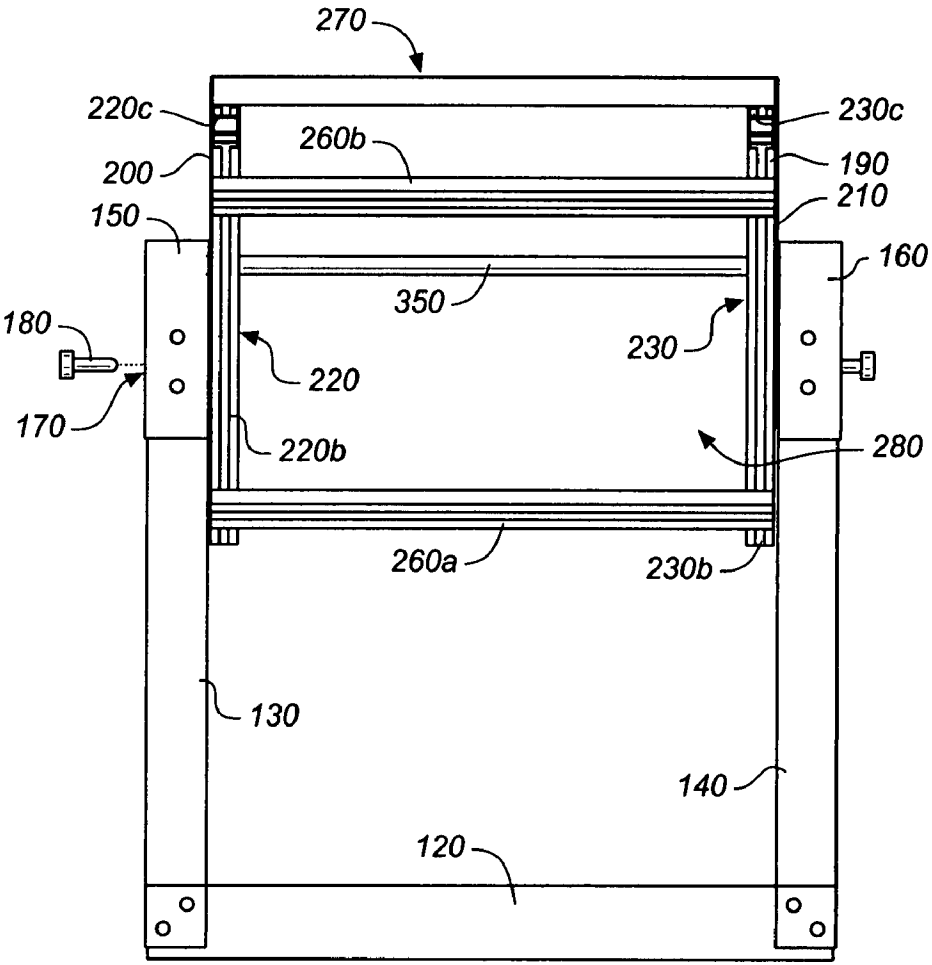
FIG. 4 is a front view in elevation of the apparatus of FIG. 3.
Figure 3:
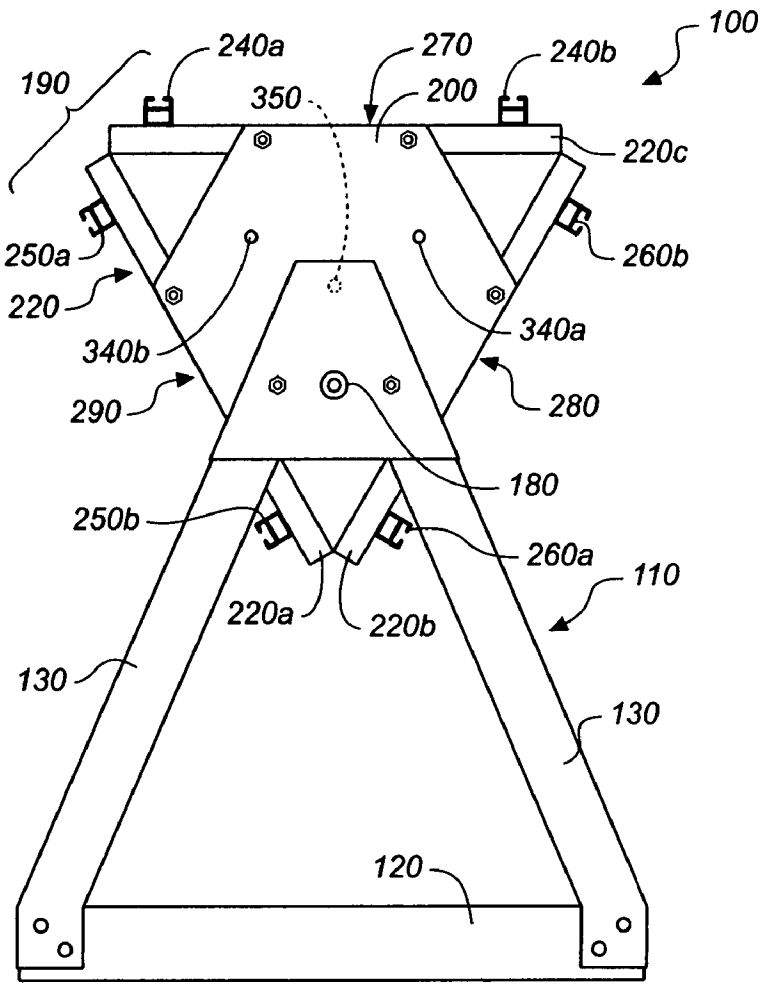
FIG. 3 is a side view in elevation of the rotatable power tool workbench of the present invention.

FIG. 1 is a perspective view of the rotatable power tool workbench of the present invention, shown with a miter saw installed on the upper platform, while FIG. 2 is a perspective of the apparatus of FIG. 1 with the saw removed. FIGS. 3 and 4 are, respectively, a side view in elevation and a front view in elevation of the workbench. These views collectively show that the rotatable power tool workbench of the present invention 100, comprises supporting frame 110 including a substantially rectangular base 120, and first and second side supports 130, 140. The side supports preferably include two support members angling toward one another and substantially converging near their upper ends, and connected at their respective lower ends to a corner of the base, thereby forming a generally triangular side. The side supports may each be reinforced along their upper ends by first and second triangular end caps 150, 160 bolted to the side supports, the first end cap including a hole 170 for a ball detent or a machined clevis pin 180, preferably having a loop handle 185 for easy removal.

Rotatably mounted on the supporting base is a rotatable work surface drum 190 having first and second ends 200, 210, preferably comprising substantially planar polygonal end plates. Affixed to each end at an end plate, and forming first and second opposing mounting rail frames 220, 230, are a plurality of U-channel mounting rail frame member extrusions 220*a–c*, 230*a–c*, angled and connected end-to-end in a substantially triangular configuration. Interposed between the mounting rail frames, and attached at each end to a mounting rail frame member, are first through third sets of tool mounting members, preferably comprising at least two tool mounting rails per mounting rail frame member, the mounting rails being denominated 240*a–b*, 250*a–b*, 260*a–b*. These transverse extrusions, essentially spanning the distance from one mounting plate to the next, form first through third work surfaces, which may also be characterized in the illustrated preferred embodiment as open rail platforms, 270, 280, 290 on which power tools 300, 320 are mounted with tool attachment means. Preferably the tool attachment means comprises a plurality of tool retaining nut-and-bolt combinations 330.

Each end plate includes a plurality of indexing holes 340*a–c,* the number of which corresponds to the number of work surfaces (or open rail platforms). The clevis pin or ball detent 180 is inserted through the cap 150 into one of the indexing holes to secure the drum into one of its available operating positions. Work surface drum 190 rotates about an axle 350 journaled at its ends by bearings 360 housed in each of the triangular caps 150. When it is desired to rotate the drum to bring up a new tool for operation, the detent or pin is removed and the work surface drum is rotated about the axle until the appropriate indexing hole is aligned with the hole through the triangular cap; then the detent is replaced. As is seen most clearly in FIG. 1, when the work surface drum is secured at any one of the indexing positions, the drum presents an uppermost work surface 270 which is substantially level relative to the ground or surface upon which the apparatus is set. The uppermost work surface provides a structure upon which to affix a tool or other device in its conventional and recommended upright orientation for use, while the other work surfaces (in this instance, 280, 290) angle downwardly toward the ground and are disposed below the upper work surface such that any attached tool (e.g., sander 320), platform, or holding device, is presented at an angle and may be partly inverted.

Figure 5:
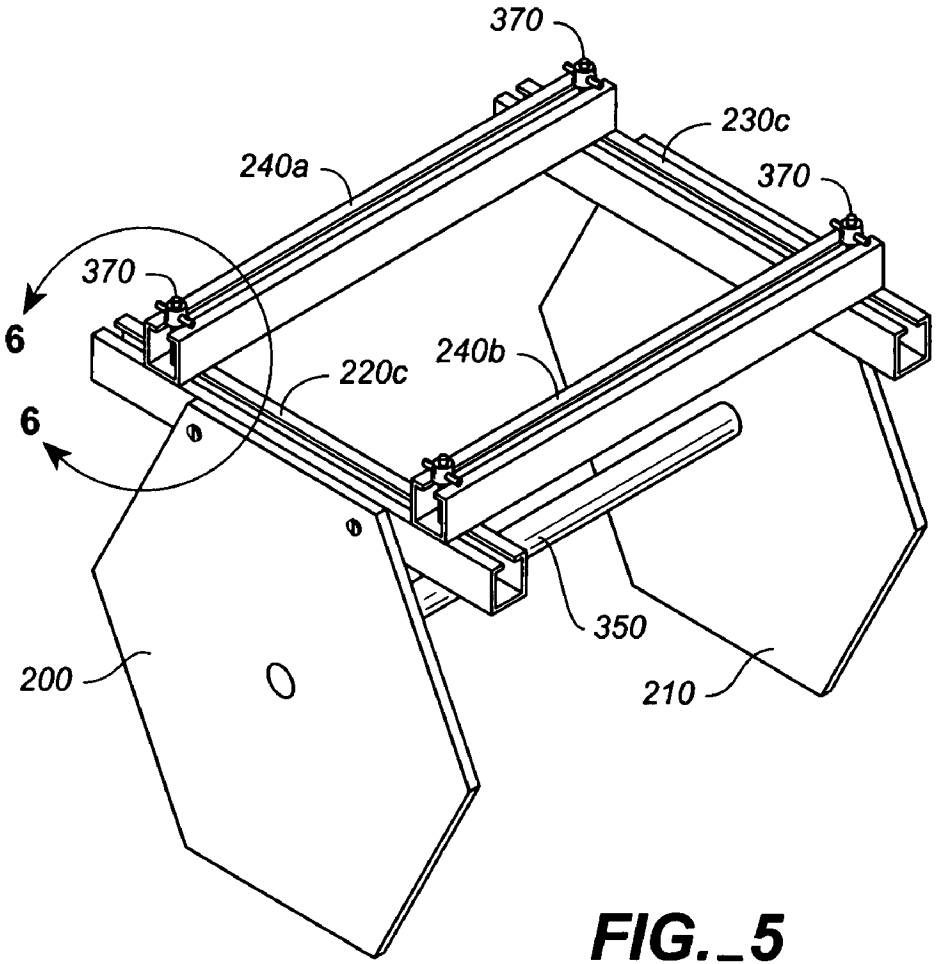
FIG. 5 is a top perspective view of the upper portion of the inventive apparatus, showing detail of the rail extrusions comprising the mounting surfaces for tools.
Figure 6:
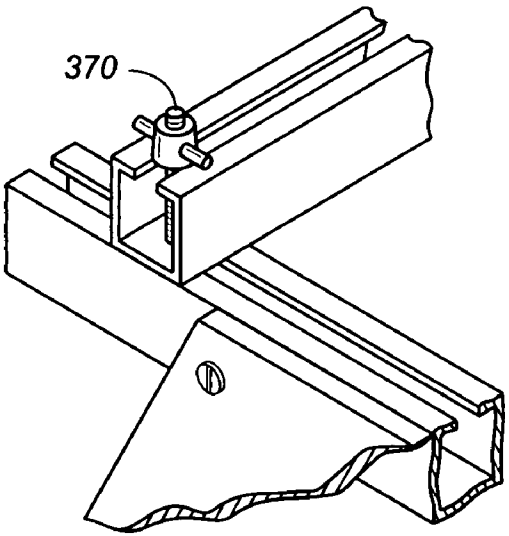
FIG. 6 is a detailed perspective view of the quick release apparatus for installing power tools on the workbench.

FIG. 5 is a top perspective view of the upper portion of the inventive apparatus, showing detail of the rail extrusions comprising the mounting surfaces for tools, and FIG. 6 is a detailed perspective view of the quick release apparatus for installing power tools on the workbench. It will be appreciated that in some instances it may be considerably more convenient to have a number of tools pre-mounted on an open rail platform than to install and remove the tool on the rails each time it is to be used. In this manner, a tool can be hung using the mounting rails as structure to place on hooks or other storage devices. When the tool is needed for use, it is simply placed (along with the mounting rails to which it is attached) on the mounting rail frames and rapidly secured with quick release nut and bolt assemblies 370.

Figure 8:
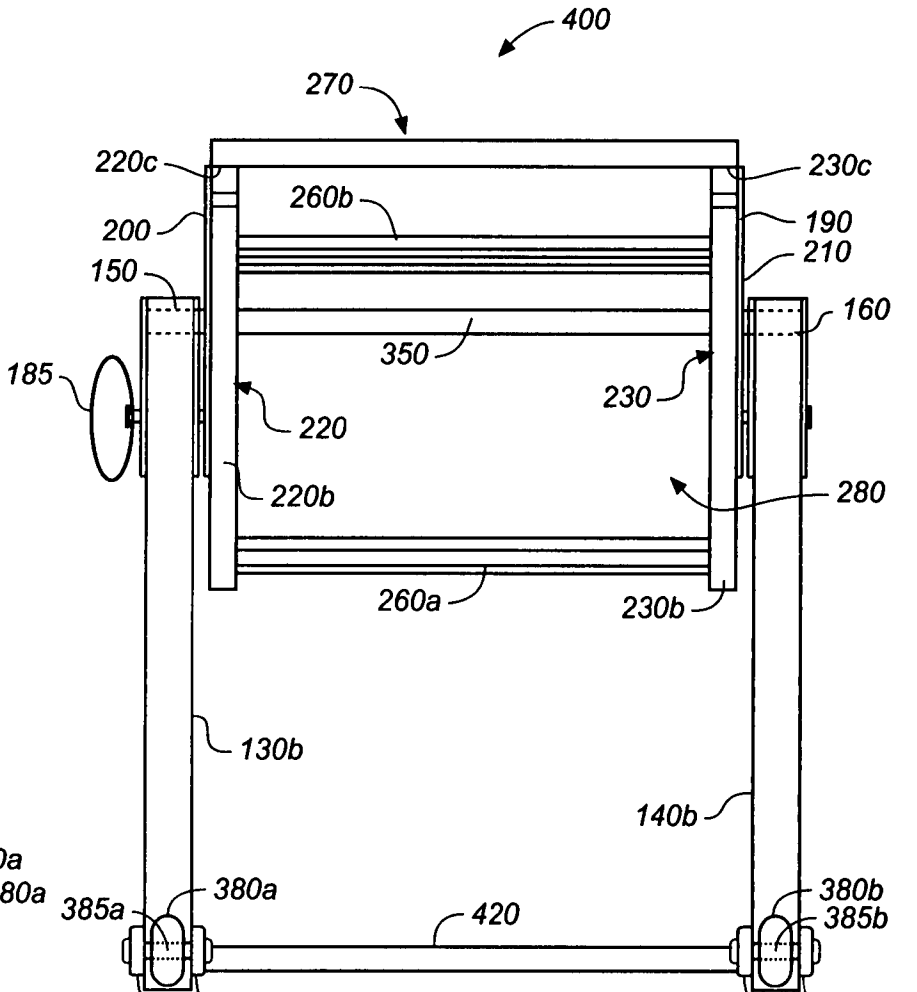
FIG. 8 is a side view in elevation of the apparatus of FIG. 7.
Figure 7:
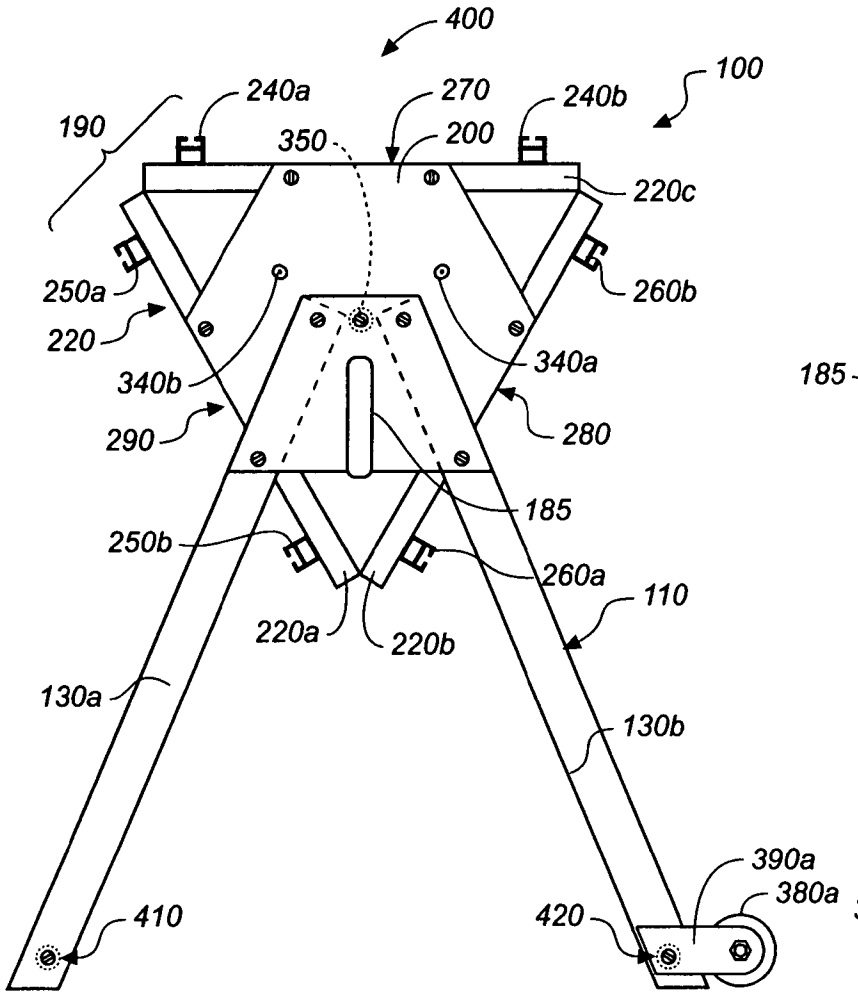
FIG. 7 is an end view in elevation showing a second preferred embodiment of the rotatable workbench of the present invention.

FIGS. 7 and 8 show a second preferred embodiment 400 of the rotatable workbench of the present invention. In this design, the base has been removed and increased structural support is provided by first and second rods 410, 420 disposed between and attached to the legs 130*a*, 130*b*, 140*a*, 140*b*, of side supports 130 and 140. To facilitate ease in transportation and in positioning the workbench in a work area, wheels 380*a*, 380*b*, may be rotatably disposed on axles 385*a*, 385*b*, journaled on brackets 390*a*, 390*b* cantilevered outwardly from the legs to elevate the wheels slightly above ground level, such that the wheels engage the ground only when the workbench is tipped slightly. However, the workbench may also include two sets of wheels comprising medium to heavy duty, single- or double-locking swivel casters with foot-operated brakes. The ultimate selection of suitable wheels will depend on the tool use contemplated.

According to the foregoing detailed description, it will be seen that in its most essential aspect, the multi-tool rotatable workbench of the present invention includes: a support structure or supporting frame, a work surface drum with at least two work surfaces. The drum is rotatably disposed on the support structure to elevate the work surfaces to a comfortable height. Each of the work surfaces includes tool attachment means so that tools, work platforms, workpiece holding devices, and the like, may be rapidly attached and removed from the work surface. Finally, in its most essential aspect, the apparatus includes drum indexing and stop means for selectively positioning and securing the work surface drum in such a configuration such that at least one work surface is oriented to present a work tool in its convention upright orientation, or, alternatively, is substantially level in relation to the ground, while all other work surfaces are in a "storage" position, meaning that the "stored" surface itself and any tools or other devices attached thereto are not presented on a substantially horizontal surface (or in a conventional upright orientation) for immediate use, but are rather disposed below the horizontal work surface.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For instance, it will be appreciated that it may be desirable to include a flat (planar) working surface on one side of the rotatable drum, rather than mounting a power tool. Accordingly, a removable work surface having mounting means can be adapted for removable attachment to the mounting rails. Other apparatus, tools, work surfaces, clamps, holding devices, and the like can similarly be adapted for mounting on the workbench in the manner described. Further, as will be appreciated by those with skill in the art, the illustration of a rotatable drum having three open rail platform work surfaces is somewhat arbitrary. As the dimensions of the inventive device diminish, physical constraints will dictate the selection of a very limited number of sides. However, it is well within the design considerations of the present invention to provide a rotatable drum having drum end plates and mounting frames with square, pentagonal, or hexagonal shapes, and thus a corresponding number of work surfaces.

Therefore, the above description and illustrations should not be construed as limiting the scope of the invention, which is defined by the appended claims.

What is claimed is:

1. A multi-tool workbench, comprising:

a supporting frame comprising first and second side supports having upper ends, and wherein said first and second side supports are reinforced at their respective upper ends by first and second triangular end caps;

a work surface drum rotatably disposed on said supporting frame, said work surface drum having a plurality of work surfaces;

tool attachment means disposed on each of said plurality of work surfaces for rapid attachment and removal of tools, work platforms, and workpiece holding devices; and drum indexing and stop means for selectively positioning and securing said work surface drum such that one work surface is uppermost and any device attached to said uppermost work surface is presented in a substantially upright orientation;

wherein one of said end caps includes a through hole for insertion of said stop means.

2. The apparatus of claim 1, further including first and second substantially planar end plates affixed to said work surface drum, wherein said indexing means is disposed on one of said end plates, said indexing means cooperating with said stop means.

3. The apparatus of claim 2, further including:

first and second mounting rail frames affixed to said first and second end plates, respectively; and a set of at least two tool mounting rails interposed between each of said mounting rail frames, whereby each set of at least two of said tool mounting rails defines an open rail work surface.

4. The apparatus of claim 3, wherein said tool mounting rails are metal extrusions.

5. The apparatus of claim 4, wherein tool attachment means comprise nut-and-bolt combinations.

6. A rotatable power tool workbench, comprising:

a support structure having vertical supports and an upper portion;

at least one axle disposed in a substantially horizontal orientation and affixed to said support structure in said upper portion; and a work surface drum having first and second ends and a plurality of work surfaces, said work surface drum rotatably mounted on said at least one axle, wherein said work surfaces comprise tool mounting members interposed between and extending from said first and second ends of said work surface drum.

7. The rotatable power tool workbench of claim 6, further including quick release nut and bolt assemblies for attaching power tools to said tool mounting members.

8. The rotatable power tool workbench of claim 6, wherein said work surface drum includes first and second end plates disposed on said first and second ends, respectively, and wherein said first end plate includes a plurality of indexing holes;

first and second caps disposed on the upper portion of each of said vertical supports, said first cap including a through hole; and a clevis pin inserted through the through hole so as to selectively engage the indexing holes on said first end plate of said work surface drum so as to enable a user to secure said work surface drum in a fixed position with one of said work surfaces in a substantially level orientation.

9. The apparatus of claim 6, wherein when at least one of said work surface is substantially level, all other work surfaces are disposed below the substantially level work surface in a stored position.

10. The apparatus of claim 6, wherein each of said side supports has an upper end and includes two support members angling toward one another and substantially converging near their upper ends.

11. The apparatus of claim 6, wherein said supporting frame further includes a support member disposed between the lower ends of each of said side supports.

12. The apparatus of claim 6, further including wheels disposed on said support frame for rolling said apparatus on the ground.

* * * * *